US007335094B2

(12) United States Patent
Shih et al.

(10) Patent No.: US 7,335,094 B2
(45) Date of Patent: Feb. 26, 2008

(54) SINGLE-LAYER POLISHING PAD AND METHOD OF PRODUCING THE SAME

(75) Inventors: Wen-Chang Shih, Taichung (TW); Yung-Chung Chang, Taipei (TW); Min-Kuei Chu, Taichung County (TW)

(73) Assignee: IV Technologies Co., Ltd., Taichung (TW)

( * ) Notice: Subject to any disclaimer, the term of this patent is extended or adjusted under 35 U.S.C. 154(b) by 0 days.

(21) Appl. No.: 11/459,352

(22) Filed: Jul. 22, 2006

(65) Prior Publication Data

US 2006/0258277 A1 Nov. 16, 2006

Related U.S. Application Data

(62) Division of application No. 10/908,232, filed on May 3, 2005, now Pat. No. 7,101,501.

(60) Provisional application No. 60/521,483, filed on May 5, 2004, provisional application No. 60/521,740, filed on Jun. 29, 2004.

(51) Int. Cl.
*B24D 11/00* (2006.01)

(52) U.S. Cl. ..... 451/527; 451/533

(58) Field of Classification Search ..... 451/526, 451/527, 528, 529, 530, 533, 534, 537, 538, 451/539

See application file for complete search history.

(56) References Cited

U.S. PATENT DOCUMENTS

| | | | | |
|---|---|---|---|---|
| 6,168,508 | B1 | 1/2001 | Nagahara et al. | |
| 6,221,773 | B1 | 4/2001 | Yasui et al. | |
| 6,544,107 | B2 | 4/2003 | Misra et al. | |
| 2004/0021243 | A1 | 2/2004 | Shih et al. | |
| 2005/0079806 | A1* | 4/2005 | James et al. | 451/41 |
| 2006/0189269 | A1* | 8/2006 | Roy et al. | 451/526 |

* cited by examiner

*Primary Examiner*—Jacob K. Ackun, Jr.
(74) *Attorney, Agent, or Firm*—Pai Patent & Trademark Law Firm; Chao-Chung David Pai

(57) ABSTRACT

A foamed plastic is cut to form a single-layer polishing pad having a desired rigidity and compressibility. A polishing surface of the polishing pad has a higher density than a mounting surface of the polishing pad. The polishing surface and the mounting surface may have different areas having different densities for achieving desired rigidity and compressibility property. Furthermore, methods of making such single-layer polishing pads are also disclosed.

6 Claims, 4 Drawing Sheets

SINGLE-LAYER POLISHING PAD AND METHOD OF PRODUCING THE SAME

CROSS-REFERENCE TO RELATED APPLICATIONS

The present application is a divisional application of U.S. patent application Ser. No. 10/908,232, filed May 3, 2005 now U.S. Pat No. 7,101,501 and, which claims the priority benefit of U.S. Provisional Application Ser. No. 60/521,483, filed May 5, 2004 and U.S. Provisional Application Ser. No. 60/521,740, filed Jun. 29, 2004. All of these applications are incorporated herein by this reference.

BACKGROUND

1. Field of Invention

The present invention relates to a polishing apparatus and manufacturing method thereof. More particularly, the present invention relates to a single-layer polishing pad and a method of producing the same.

2. Description of Related Art

During the manufacturing process of semiconductor integrated circuits, isolation structures, metal lines and dielectric layers are stacked layer by layer, and the surface of a wafer is thus less and less planar. Limited by the focus depth of an exposing machine, pattern transferal from a photomask to a photoresist layer is increasingly difficult, and the exposed pattern of the photoresist layer is increasingly distorted. Chemical mechanical polishing (CMP) is the only true global planarization process to resolve the problem mentioned above.

In CMP, a wafer is pressed against on a polishing pad to allow movement of the wafer on the polishing pad having polishing slurry thereon. The polishing slurry contains fine abrasive particles and a chemical reagent. Both the wafer and the polishing pad are rotated automatically; hence the wafer is planarized by mechanical polishing by the abrasive particles and chemical reaction of the chemical reagent.

An important goal of CMP is achieving uniform planarity of the wafer surface, and the uniform planarity also has to be achieved for a series of wafers processed in a batch. The rigidity (or stiffness) and the compressibility (or compliance) of a polishing pad have great influence on the planarity of the polished wafer. Generally speaking, a polishing pad with higher rigidity can increase the polishing planarity of the polished wafer, and a polishing pad with higher compressibility can increase the polishing uniformity of the polished wafer. Therefore, a wafer polished by a rigid polishing pad often needs to be further polished by a soft polishing pad to improve the polishing uniformity. The CMP process thus suffers from low throughput.

Conventionally, to satisfy both the planarity and the uniformity requirements of the CMP process, at least a layer of rigid pad and at least a layer of soft pad are stacked to form a desired composite polishing pad, such as the polishing pads disclosed by U.S. Pat. Nos. 5,212,910 and 5,257,478. As stated in U.S. Pat. No. 6,217,426, although a composite polishing pad can partially satisfy both the planarity and the uniformity requirements of the CMP process, some other problems are also produced. For example, pressure transmission is different for a rigid pad and a soft pad, and the polishing uniformity can sometimes be poor. Furthermore, a greater number of layers stacked in a composite polishing pad creates more variables that can affect the rigidity and compressibility of the composite polishing pad. Hence, the polishing planarity and uniformity are more difficult to control.

Besides, if the two pads in a composite polishing pad are not adhered well enough, the composite polishing pad may easily delaminate during the polishing process. Therefore, U.S. Pat. No. 6,217,426 discloses a polishing pad having a pattern of protrusions on the mounting surface of the polishing pad to limit the pressure transmission area and increase compressibility of the polishing pad.

In the prior art described above, the cost and complexity in producing a polishing pad are unavoidably increased.

SUMMARY

In one aspect, the present invention provides a single-layer polishing pad having desired rigidity and compressibility to meet the requirements of polishing planarity and uniformity.

In another aspect, the present invention provides a method of producing a single-layer polishing pad having desired rigidity and compressibility. The method utilizes the pore-size-distribution property in a porous polymer to control the rigidity and compressibility of a polishing pad.

In accordance with the foregoing and other aspects of the present invention, a single-layer polishing pad is provided. The single-layer polishing pad comprises a body, a polishing surface on one side of the body, and a mounting surface on the other side of the body. The body is made of a porous polymer, and the density of the polishing surface and the density of the mounting surface are different.

In a preferred embodiment of the present invention, the density of the polishing surface is higher than the density of the mounting surface.

In another preferred embodiment, the polishing surface has at least a first area and at least a second area, and the density of the first area is higher than the density of the second area.

In yet another preferred embodiment, the mounting surface has at least a third area and at least a fourth area, and the density of the third area is higher than the density of the fourth area.

In yet another preferred embodiment, the single-layer polishing pad comprises a polishing surface, a mounting surface, and a central part between the polishing surface and the mounting surface, and the porosity of the central part is higher than the porosity of the polishing surface.

In accordance with the foregoing and other aspects of the present invention, a method of producing a single-layer polishing pad is provided. A foamed pad is formed by a foam process, and the foamed pad has a first planar surface and a second planar surface. A third planar surface is formed by removing the first planar surface. The density of the second planar surface, which serves as a polishing surface, is higher than the density of the third planar surface, which serves as a mounting surface.

In accordance with the foregoing and other aspects of the present invention, a method of producing a single-layer polishing pad is provided. A foamed pad is formed by a foam process. The foamed pad has at least a first region and at least a second region, and the thickness of the first region is larger than the thickness of the second region. A first planar surface is formed by removing a surface of the foamed pad. The density of the first planar surface on the first region is lower than the density of the first planar surface on the second region.

In a preferred embodiment, a second planar surface is formed by removing the other surface of the foamed pad.

In the foregoing, a pore-size-distribution property in a porous polymer is utilized to produce a single-layer polishing pad having two surfaces with uniform rigidity or various rigidities. Therefore, not only can the requirements for lower cost and higher CMP process throughput be achieved, but also the polishing planarity and uniformity can be achieved.

It is to be understood that both the foregoing general description and the following detailed description are made by use of examples and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE PREFERRED EMBODIMENTS

Figure 1:
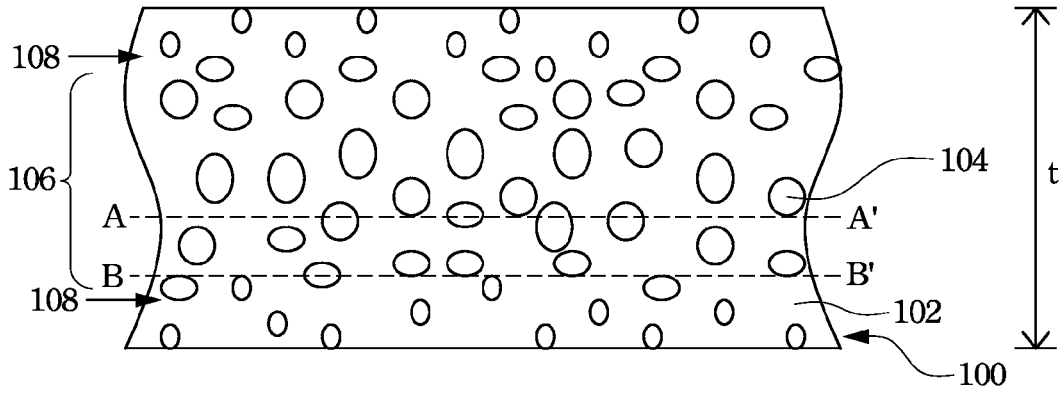
FIG. 1 is a cross-sectional diagram illustrating foamed cells distributed in a foamed polymer.

Reference will now be made in detail to the present preferred embodiments of the invention, examples of which are illustrated in the accompanying drawings. Wherever possible, the same reference numbers are used in the drawings and the description to refer to the same or like parts.

This invention provides a single-layer polishing pad having desired rigidity and compressibility and a method producing the same. In a preferred embodiment, a pore-size-distribution property in a foamed polymer is used to produce a polishing pad with optimum rigidity to solve problems of conventional polishing pads.

After adding a foaming agent or a gas into a polymer, a foamed polymer can be formed by conventional foam processes. There are many foamed cells with various sizes in the foamed polymer. Generally, small foamed cells are distributed near the surfaces of the foamed polymer, and large foamed cells are distributed in the central part of the foamed polymer, as shown in FIG. 1.

FIG. 1 is a cross-sectional diagram illustrating foamed cells distributed in a foamed polymer. In FIG. 1, the foamed polymer 100 is composed of a polymer 102 having foamed cells 104. In the surface regions 108 of the foamed polymer 100, the foamed cells 104 are smaller. In the interior regions 106 of the foamed polymer 100, the foamed cells 104 are larger. Therefore, the density of the foamed polymer 100 in the interior region 106 is lower than that in the surface regions 108. That is, the porosity, i.e. pore volume in a unit volume, of the interior region 106 is higher than the porosity of the surface regions 108. Moreover, the porosity gradually increases from the surface regions 108 to the center of the interior region 106. Therefore, the rigidity of the surface regions 108 in the foamed polymer 100 is greater, and the compressibility of the interior region 106 is better.

Embodiment 1

According to a preferred embodiment, a polishing pad is formed by the foam process described above. Reference is made to FIG. 1; the polymer 102 of the foamed polymer 100 is preferably polyurethane, epoxy resin, phenol formaldehyde resin, melamine resin or other suitable thermosetting resins. The foamed polymer 100 can be made by any suitable foam process, such as injection molding. The material of the polymer 102 and the porosity of the foamed polymer 100 can affect the rigidity of the foamed polymer 100. Since any one skilled in the art can adjust the relevant factors affecting the rigidity of the foamed polymer 100, a detailed discussion of the same is omitted here.

The ratio of the porosity of the interior region 106 (Pi) over the porosity of the surface region (Ps), i.e. Pi/Ps, is preferably larger than 1.3, and more preferably greater than 1.5. The thickness of the foamed polymer 100 is preferably about 2 mm to about 8 mm.

Figure 2A:
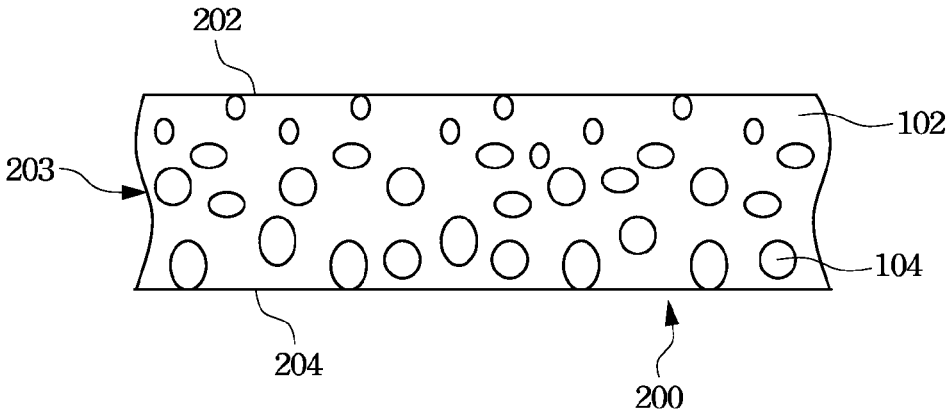
FIGS. 2A-2B are cross-sectional diagrams showing polishing pads according to a first preferred embodiment of this invention.
Figure 2B:
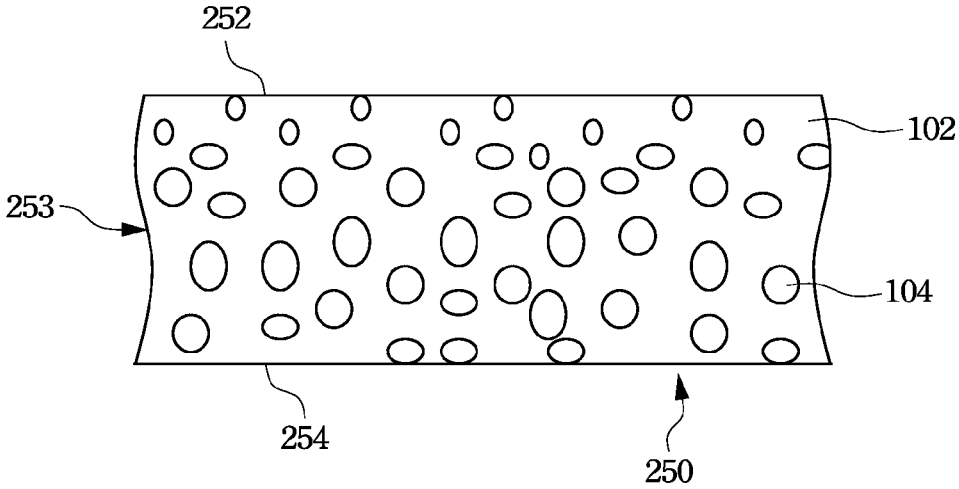

Therefore, a suitable cutting position can be chosen along the thickness direction t of the foamed polymer 100. For example, cutting the foamed polymer 100 along the cutting lines A-A' or B-B' can obtain the polishing pads 200 or 250 as shown in FIGS. 2A or 2B, respectively. Comparing the polishing pad 200 in FIG. 2A and the polishing pad 250 in FIG. 2B, since the density of bottom surface 204 of the polishing pad 200 is less than the density of the bottom surface 254 of the polishing pad 250, the bottom surface 204 is softer than the bottom surface 254; i.e. the bottom surface 204 is more compressible than the bottom surface 254.

Generally speaking, in the polishing pad 200 in FIG. 2A and the polishing pad 250 in FIG. 2B, since the density of the top surfaces 202 and 252 are denser, and thus less porous, the top surfaces 202 and 252 are more rigid. Therefore, the top surfaces 202 and 252 usually serve as polishing surfaces to contact directly with, for example, wafers. The bottom surfaces 204 and 254 are less dense, therefore more porous, and usually serve as mounting surfaces for mounting the polishing pads 200 and 250 on a polishing device.

Moreover, for the polishing pad 200 and 250, the central parts 203 and 253 are more porous than the top surfaces 202 and 252, respectively, and the porosity thereof gradually increases from the top surfaces 202 and 252 to the central parts 203 and 253, respectively. The porosity ratios of the central part 203 and 253 to the top surfaces 202 and 252, respectively, are preferably greater than 1.3, and more preferably greater than 1.5. For example, when the porosity of the top surface 202 or 252 is 20%, the porosity of the central part 203 or 253 is greater than 30%.

A polishing pad with higher rigidity can achieve better polishing planarity; a polishing pad with higher compressibility can achieve better polishing uniformity. Accordingly, a polishing pad having desired rigidity and compressibility can be obtained by choosing a suitable cutting position along the thickness direction of a foamed polymer.

Embodiment 2

Figure 3:
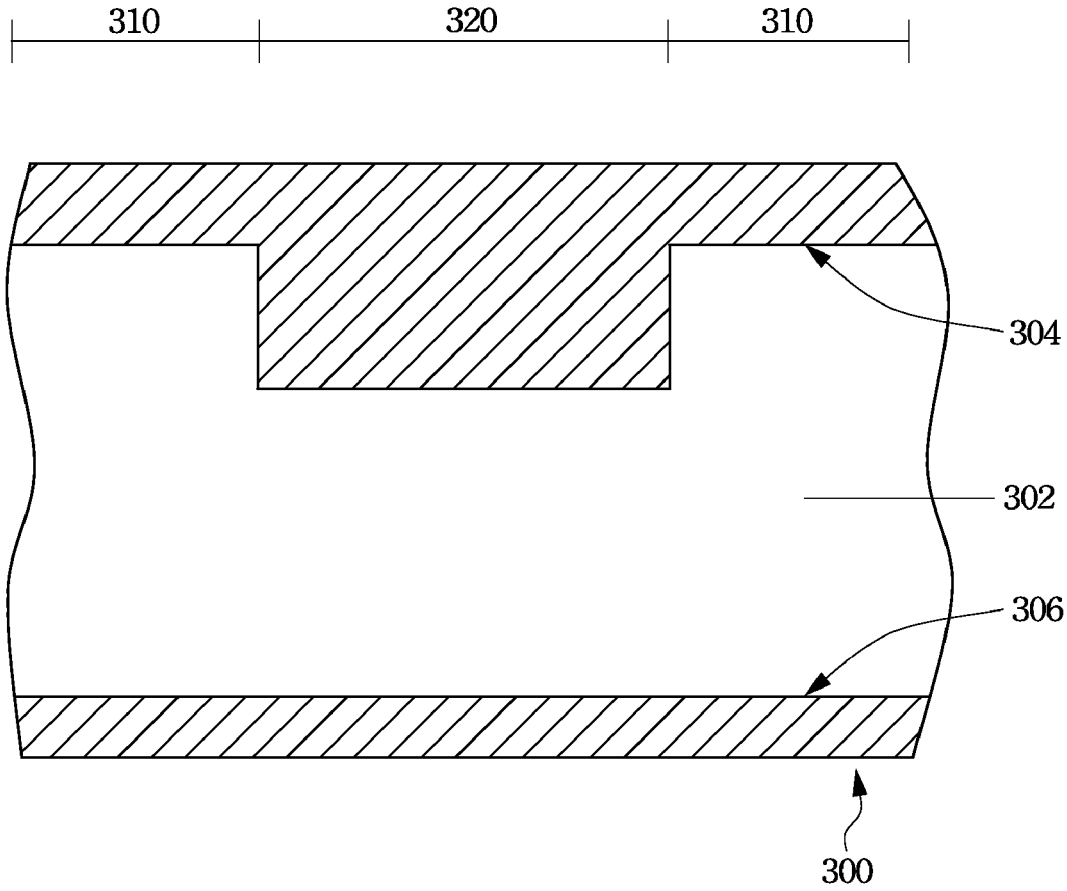
FIG. 3 is a cross-sectional diagram showing a mold according to a second preferred embodiment of this invention.

According to another embodiment, a mold, as shown in FIG. 3, can be used to produce a desired polishing pad by a foam process. FIG. 3 is a cross-sectional diagram showing a mold according to a second preferred embodiment of this invention. In FIG. 3, the mold 300 has a cavity 302, the interior bottom surface 306 is planar, and the interior top surface 304 is non-planar. Hence, the cavity 302 can be divided into at least two regions having different spacing. That is, a region 310 has a larger spacing and a region 320 has a smaller spacing.

Figure 4:
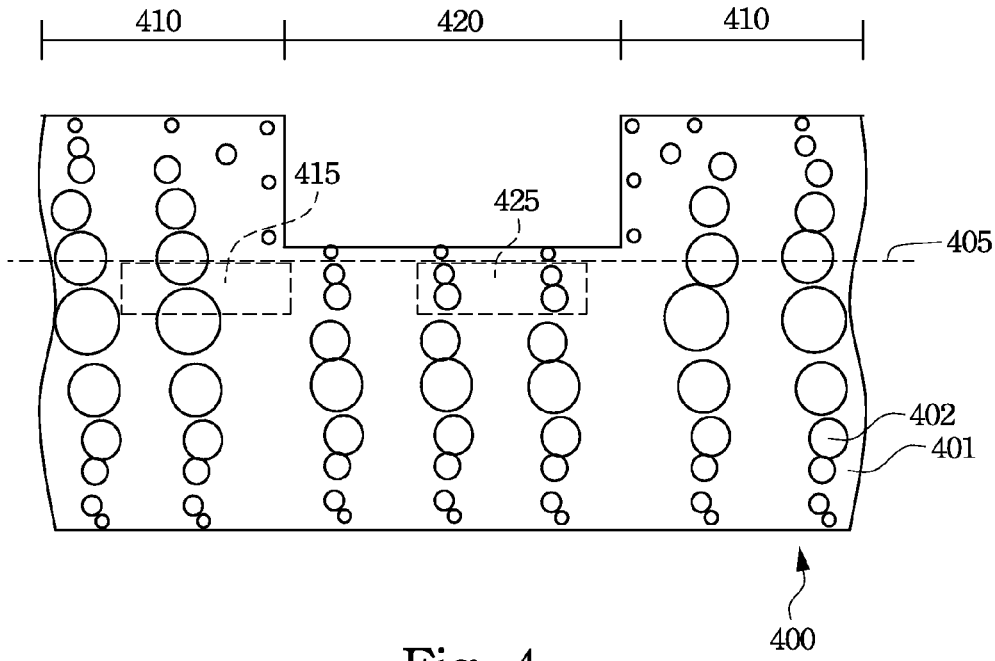
FIG. 4 is a cross-sectional diagram showing a foamed polymer formed by using the mold shown in FIG. 3.

For example, a polymer is injected into the mold cavity 302 of the mold 300 in an injection molding process with a foaming agent, a gas, or a combination thereof added. The polymer is foamed in the cavity 302 of the mold 300 to form a foamed polymer 400, as shown in FIG. 4. FIG. 4 is a cross-sectional diagram showing a foamed polymer formed by using the mold shown in FIG. 3. The polymer 401 of the foamed polymer 400 is preferably polyurethane, epoxy resin, phenol formaldehyde resin, melamine resin, or other suitable thermosetting resins. The material of the polymer 401 and the porosity of the foamed polymer 400 can affect the rigidity of the foamed polymer 400. Since anyone skilled in the art can adjust the relevant factors affecting the rigidity of the foamed polymer 400, detailed discussion of the same is omitted here.

In FIG. 4, the pore size distribution of the foamed cells 402 in the foamed polymer 400 is similar to the pore size distribution as discussed above. That is, smaller foamed cells 402 are distributed near the surfaces of the foamed polymer 400, and larger foamed cells are distributed in the interior region of the foamed polymer. Moreover, the foamed polymer 400 has two regions with different thicknesses, i.e. a thicker region 410 and a thinner region 420. Therefore, even at the same level, such as level 405, of the foamed polymer 400, the porosity is different in different regions. For example, the density of the region 415 is less than the density of the region 425, and both the regions 415 and 425 are near the level 405. The reason is that the region 415 is in the thicker region 410, and the region 415 is thus located in the interior region of the foamed polymer 400. In contrast, the region 425 is in the thinner region 420, and the region 425 is thus located in the surface region of the foamed polymer 400.

Figure 5:
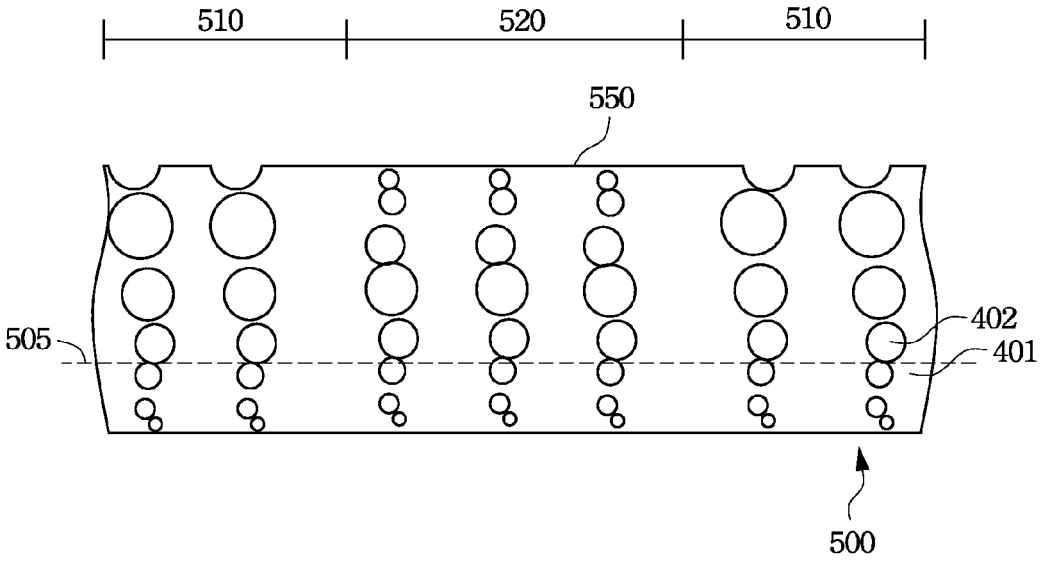
FIG. 5 is a cross-sectional diagram showing a polishing pad formed by cutting the foamed polymer shown in FIG. 4.

If the foamed polymer 400 is cut along the level 405, a polishing pad as shown in FIG. 5 is obtained. In FIG. 5, the polishing surface 550 of the polishing pad 500 has at least a soft area 510 and at least a rigid area 520 corresponding to the thicker region 410 and the thinner region 420, respectively. As discussed in FIG. 4, the density of the soft area 510 is smaller, and the density of the rigid area 520 is larger. Hence, the compressibility of the soft area 510 is better, and the soft area 510 can provide better polishing uniformity. The rigidity of the rigid area 520 is larger, and the rigid area 520 can provide better polishing planarity.

In addition, the polishing pad 500 can be further cut along the line 505. Hence, the compressibility of the mounting surface of the polishing pad can be further adjusted.

Figure 6A:
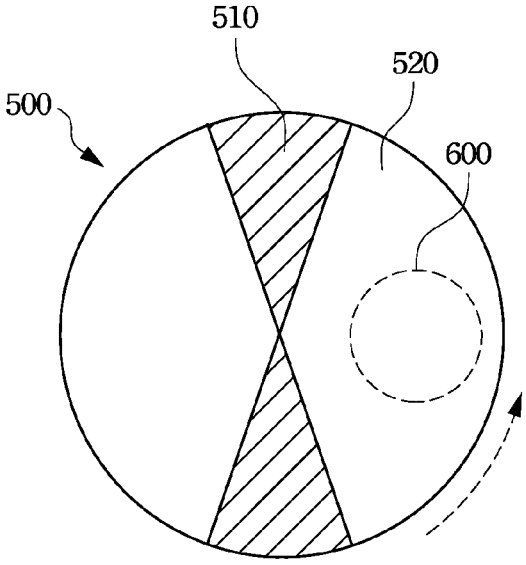
FIGS. 6A-6D are cross-sectional diagrams showing the distribution of soft regions and rigid regions on the polishing surface of the polishing pad shown in FIG. 5.

FIGS. 6A-6D are cross-sectional diagrams showing the distribution of soft regions and rigid regions on the polishing surface of the polishing pad shown in FIG. 5. In FIG. 6A, a circular polishing pad 500 is divided into several sectors, and the soft areas 510 and the rigid areas 520 are arranged alternately. The ratio of the surface area of the soft areas 510 over the surface area of the rigid areas 520 can be adjusted according to the desired polishing planarity and uniformity. When a wafer 600 moves around on the polishing pad 500, the wafer 600 passes the soft area 510 and the rigid areas 520 orderly. Hence, both the polishing uniformity and the polishing planarity can be achieved.

Figure 6B:
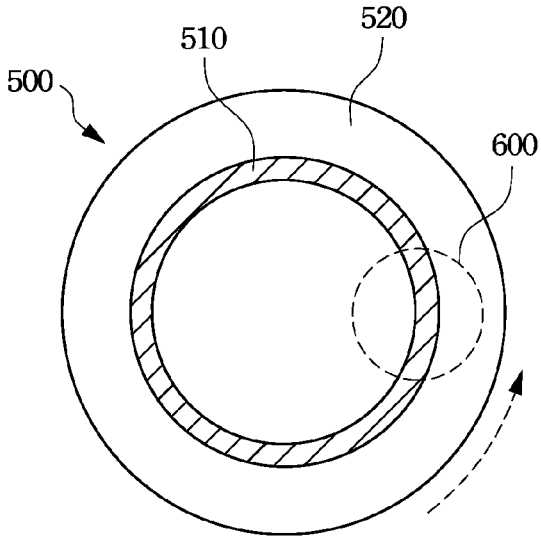
Figure 6C:
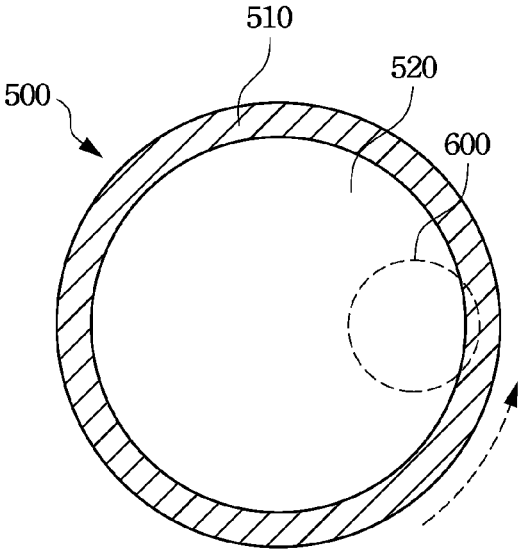
Figure 6D:
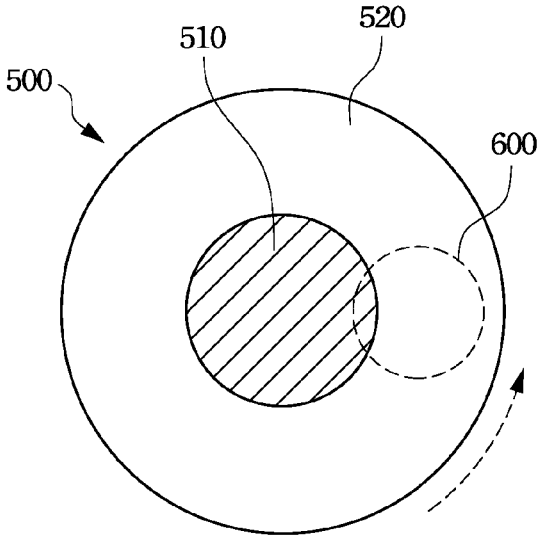

In FIG. 6B, the soft area 510 is located at the center of the passing area of the wafer 600. That is, the shape of the soft area 510 is like a ring located between the center and the circular edge of the polishing pad 500 to provide better polishing uniformity for the center region of the wafer 600. In FIG. 6C, the soft area 510 is located at the perimeter of the polishing pad 500 to provide better polishing uniformity for the edge region of the wafer 600. In FIG. 6D, the soft area 510 is circle and located at the central region of the polishing pad 500 to provide better polishing uniformity for the edge region of the wafer 600.

The allocation of the soft area 510 and rigid area 520 on the polishing pad 500, as illustrated in FIG. 5 and FIGS. 6A-6D, can also be applied on the bottom surface of the polishing pad 500. Therefore, the rigidity of the polishing pad 500 can be further adjusted to provide better polishing planarity and uniformity. Besides, the shape of the polishing pad 500 is not limited to a circle, and the shape also can be, for example, a square or a rectangle. The allocation of the soft area and rigid area also can be varied according to the shape of the polishing pad and the desired polishing planarity and uniformity. Since anyone skilled in the art can adjust the relevant factors, a detailed discussion of the same is omitted here.

In light of the foregoing, the pore-size-distribution property in a foamed polymer is used to foam a polymer in a mold having a cavity with variable spacing between the interior top surface and the interior bottom surface in different regions. A polishing pad having a desired allocation of soft areas and rigid areas can be obtained through adjusting the level difference of the interior top and/or bottom surface in different regions of the mold's cavity, the allocation of different regions of the mold's cavity, and removing the top and/or the bottom surface of the foamed polymer. Therefore, the polishing planarity and uniformity can be easily achieved.

From the preferred embodiments described above, a pore-size-distribution property in a porous polymer is utilized to produce a single-layer polishing pad having two surfaces with uniform rigidity or various rigidities. The polishing pad described above is a single-layer polishing pad, and the rigidity and compressibility of the top and bottom surfaces of the polishing pad can be easily controlled by various factors, such as the cavity's shape of the mold used to foam a polymer, the material of the polymer, the foamed level of the foamed polymer, and the cutting process of the foamed polymer. Therefore, not only can the requirements of lower cost and higher CMP process throughput be easily achieved, but also the polishing planarity and uniformity can be easily achieved.

The method of producing a porous polymer is not limited to a foam process; other suitable methods, such as embedded polymeric microelement, sintered polymer particles, or fiber coating, can also be used. Moreover, the usage of the single-layer polishing pad, according to the preferred embodiments of this invention, is not limited to CMP applied on a wafer; other polishing process applied on glass or other substrates can also use the single-layer polishing pad provided by the preferred embodiments of this invention.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A single-layer polishing pad made of a porous polymer, the single-layer polishing pad comprising:

a polishing surface having a first porosity;

a mounting surface having a second porosity; and a central part between the polishing surface and the mounting surface and having a third porosity, wherein the ratio of the third porosity to the first porosity is higher than 1.3.

2. The single-layer polishing pad of claim 1, wherein the second porosity is higher than the first porosity.

3. The single-layer polishing pad of claim 1, wherein the polishing surface has at least a first region and at least a second region over different areas and the porosity of the first region is higher than the porosity of the second region.

4. The single-layer polishing pad of claim 3, wherein a shape of the first region is a sector, a ring or a circle.

5. The single-layer polishing pad of claim 1, wherein the mounting surface has at least a third region and at least a fourth region over different areas and the porosity of the third region is higher than the porosity of the fourth region.

6. The single-layer polishing pad of claim 5, wherein a shape of the third region is a sector, a ring or a circle.

* * * * *